United States Patent [19]

Cohn

[11] 3,981,597

[45] Sept. 21, 1976

[54] SHAVING CREAM DISPENSER

[76] Inventor: Bernard Cohn, 100 Princeton Ave., Bridgeton, N.J. 08302

[22] Filed: May 28, 1975

[21] Appl. No.: 581,643

[52] U.S. Cl. ..... 401/190; 222/190; 222/402.13; 401/270

[51] Int. Cl.[2] ..... A46B 11/02

[58] Field of Search ..... 401/190, 270; 222/153, 222/191, 394, 402.11, 402.13, 402.15, 402.21–402.24, 190

[56] References Cited

UNITED STATES PATENTS

| | | | |
|---|---|---|---|
| 3,184,781 | 5/1965 | Hoxie | 401/190 X |
| 3,314,576 | 4/1967 | Focht et al. | 222/402.13 |
| 3,387,911 | 6/1968 | Focht | 401/190 |
| 3,422,996 | 1/1969 | Lipman | 222/402.11 |

*Primary Examiner*—Allen N. Knowles
*Assistant Examiner*—Hadd Lane
*Attorney, Agent, or Firm*—Darby & Darby

[57] ABSTRACT

A shaving cream dispenser has a brush removably mounted in a housing that permits a purchaser to selectively depress the valve of a standard shaving cream aerosol can to cause the pressurized cream to be dispensed from the can into the center of the brush. In one embodiment the bristles are mounted at right angles to the axis of the cylindrical aerosol can. In this embodiment a separate platform, which can be selectively depressed by the purchaser, has a bore on its underside to fit over the valve and a passageway to guide the shaving cream from the valve exit to the brush. In another embodiment, the bristles are mounted parallel to the axis of the cylindrical can. The valve is activated by depressing the housing in which the bristles are mounted. The housing has flanges which seat upon shoulders to prevent the accidental depression of the housing.

6 Claims, 10 Drawing Figures

SHAVING CREAM DISPENSER

BACKGROUND OF THE INVENTION

1. Field of the Invention

The present invention relates to coating applicators, and in particular applicators that include container closure and a brush applicator.

2. Prior Art

Found in the prior art are numerous brush applicators which are affixed to aerosol containers and through which the material in the aerosol container is discharged. These prior art devices take many forms and shapes. Representative of such devices are the structures taught in the following references: U.S. Pat. Nos. 2,849,737; 3,032,803; 3,093,857; and 3,351,418.

Despite their various approaches, these prior art devices suffer from common faults. For example, in the devices where the bristles are parallel to the axis of the aerosol can accidental discharge is not eliminated. That is, during use of the brush, axial pressure is placed upon the applicator causing it to sometimes unintentionally depress the aerosol valve causing a discharge of the can's contents.

Although accidental discharge because of pressure on the bristles during "brushing" is not a paramount problem in the applicators where the bristles are oriented at right angles to the axis of the can, these applicators also suffer from accidental discharge. For example, often the means for depressing the aerosol valve is exposed and can easily be activated during "brushing".

Other problems are also encountered in many of the prior art devices. The applicator is usually made of a durable material, e.g., thermoplastic. Therefore, its anticipated life is considerably longer than that of the bristles. However, many of the prior art devices permanently embed the bristles in a relatively expensive component of the applicator. This requires that an entire new applicator be purchased upon failure of the bristles.

Therefore, it is an object of the present invention to design an applicator with a brush for aerosol cans not susceptible to accidental discharge.

It is another object of the present invention to design an applicator with a easily and inexpensively replaceable bristle portion.

It is another object of the invention to design an applicator in conformity with the above objects that is easily manufactured using conventional thermoplastic molding techniques.

SUMMARY OF THE INVENTION

The present invention is an apparatus for dispensing and applying shaving cream for attachment to a cylindrical aerosol can that has an outwardly extending flange surrounding its top surface and an axially movable cylindrical valve on its top surface, the depression of which permits shaving cream to be dispensed through the valve. The attachment comprises a housing having an inwardly extending lip. The lip is of smaller diameter than the flange of the can and removably engages that flange. A base is provided having bristles for removably mounting the bristles in the housing. A duct is provided in said basee connected to a nozzle at the end of the base opposite the bristles. The nozzle is concentric and communicates with the duct. Also provided is an enlarged bore connected to the orifice for slipping over the valve. A seat terminates the enlarged bore for engaging the top surface of the valve. Means are provided for selectively moving the seat to depress the valve, whereby the shaving cream is dispensed from the can, through the valve, and into the bristles.

BRIEF DESCRIPTION OF THE FIGURES

The invention will be more fully understood by reference to the following detailed description taken in connection with the accompanying drawings, in which.

DESCRIPTION OF THE PREFERRED EMBODIMENTS

Figure 1:
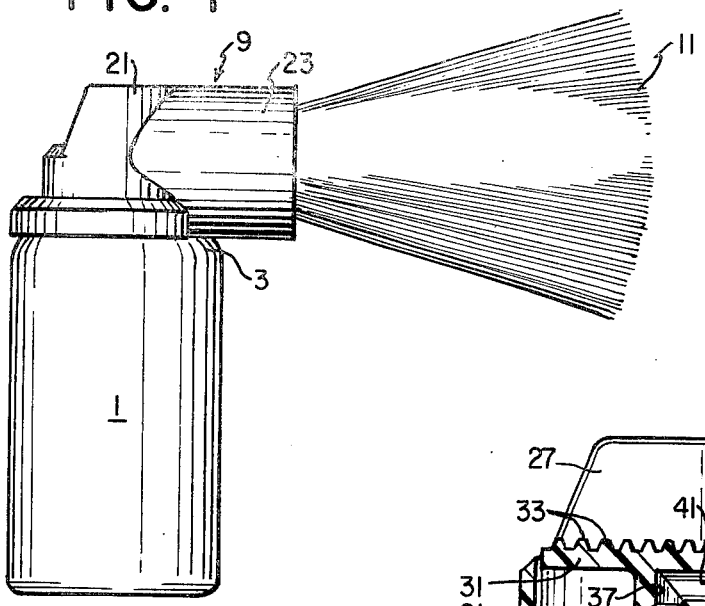
FIG. 1 is a side elevation view of the first embodiment of the present invention.

In FIGS. 1–4 one of the preferred embodiments of the present invention is illustrated. As with both preferred embodiments, the embodiment of FIGS. 1–4 is adaptable to ordinary shaving cream aerosol cans.

The standard aerosol shaving cream can 1 is substantially cylindrical. Surrounding its upper surface 3 is an outwardly extending flange 5. Flange 5 is normally formed by overturning and seaming the top edge of can 1.

Mounted in the center of can 1 on upper surface 3, concentric with flange 5, is a valve 7. Valve 7 is perpendicular to upper surface 3 and is axially movable a limited amount downward toward can 1. When valve 7 is depressed, it opens the interior of can 1, permitting the pressurized shaving cream to flow from the interior of can 1 through valve 7 to the outside.

The preferred embodiment of applicant's invention comprises a housing 9 from which bristles 11 extend horizontally, i.e., substantially perpendicular to the vertical axis of cylindrical can 1.

Figure 2:
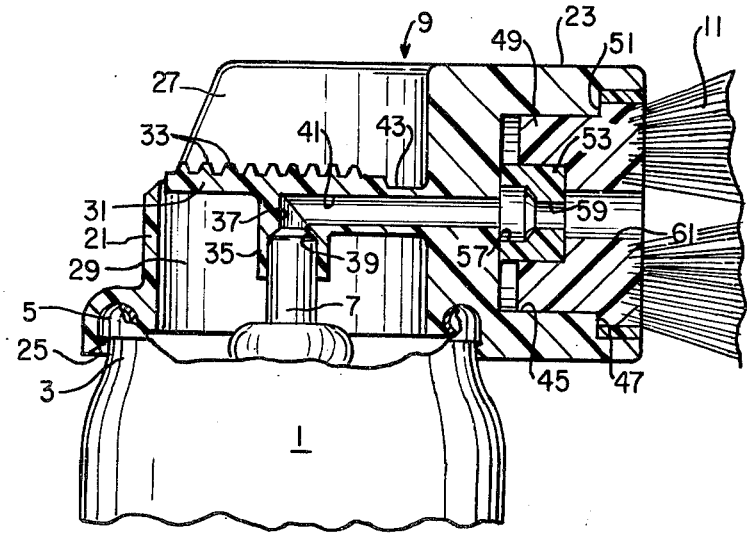
FIG. 2 is a partial cross-sectional side elevation view of the first embodiment of the present invention.
Figure 3:
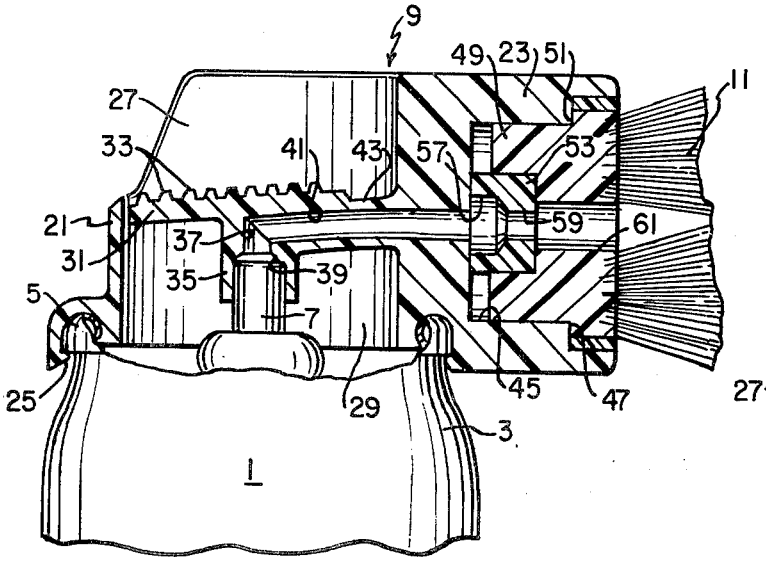
FIG. 3 is a view of the first embodiment of the present invention in an operated state and is similar to the view shown in FIG. 2.
Figure 4:
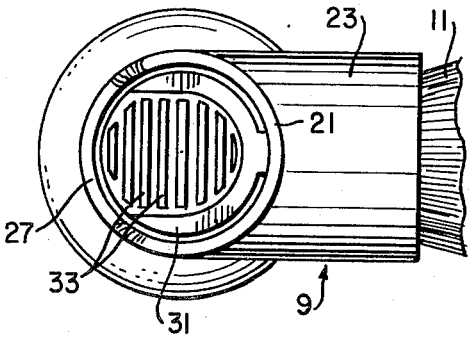
FIG. 4 is a plan elevation view of the first embodiment of the present invention.
Figure 5:
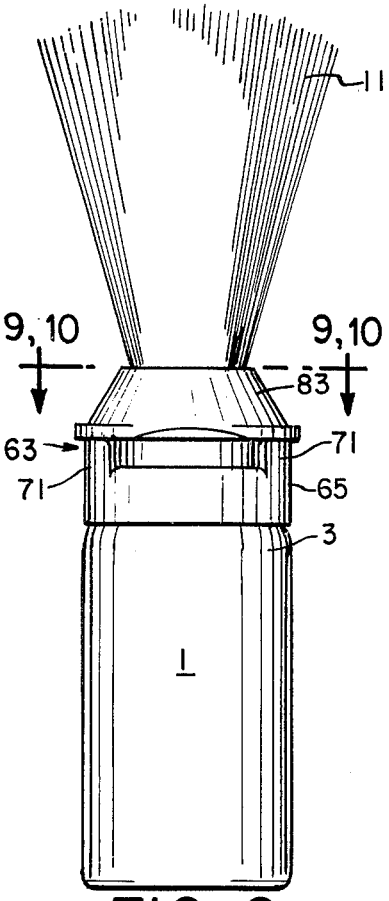
FIG. 5 is a side elevation view of the second embodiment of the present invention.

FIGS. 2–4 illustrate the detailed features of housing 9. Housing 9 has four principal functional sections: means to attach housing 9 to can 1, means to depress valve 7, means to support bristles 11, and means to deliver shaving cream to bristles 11. In particular, housing 9 comprises a substantially annular wall 21, whose axis is congruent with the axis of can 1, and annular wall 23, whose axis is perpendicular to the axis of wall 21, and whose edge is affixed to the outside of wall 21.

Attachment means is located at the bottom of wall 21, i.e., closest to surface 3. An inwardly extending lip 25 has an inner diameter slightly smaller than that of flange 5. Wall 21 is made from a somewhat flexible material, which permits lip 25 to flex outwards when housing 9 is pushed against can 1, removably attaching housing 9 to can 1.

Valve depression means includes in the upper rear portion of wall 21 opposite wall 23 finger opening 27. Substantially covering cavity 29 defined by wall 21 below finger opening 27 is platform 31. Platform 31's upper surface carries ribs 33. Tube 35, attached at one end to the bottom of platform 31, slips over valve 7. At a distance not greater than the height of depressed valve 7 from its open end, the inner diameter of bore 37 of tube 35 decreases to form a seat 39 for the top of valve 7. Depression of platform 31 fully depresses nozzle 7.

Shaving cream delivery means includes tube 35. Tube 43, having a bore 41, has one end connected to tube 35 and its other end to wall 21. Tube 43 is also attached along its length to the underside of platform 21 and is congruent to the axis of annular wall 23.

Bristle support means include wall 23. The interior surface 45 of wall 23 has a shoulder 47 near the front edge of wall 23.

Bristle base 49, having a step 51, slides into bore 52 defined by annular wall 23. Step 51 seats against shoulder 47.

Bristles 11 are embedded in one end of base 49. The other end of base 49 has a concentrically mounted nozzle 53. The base 55 of nozzle 53 extends below the end of base 49 to firmly contact the outer surface of wall 21 above the outlet of bore 41. Enlarged bore 57 of nozzle 53 has an orifice 59, which foams the pressurized cream. Bore 59 opens into duct 61 in base 49, allowing the foamed cream to pass onto bristles 11.

In the preferred embodiment housing 9 is manufactured as one piece, and plug 49 with nozzle 53 and bristles 11 are manufactured as a second piece. Thus, although the parts of housing 9 have been described as separate components, it is contemplated that modern plastic technology permits these "parts" to be formed from a few castings.

Since base 49 is removably mounted in housing 9, it can be removed and replaced when bristles 11 have passed their useful life.

Operation of FIGS. 1–4

After purchasing a standard shaving cream aerosol can 1, the purchaser removes the dispensing nozzle (not shown) on valve 7. He replaces the removed nozzle with housing 9 by snapping lip 25 over flange 5. In so doing, bore 37 of tube 35 slips over valve 7, seating valve 7 against seat 39.

The purchaser may then moisten bristles 11 and place bristles 11 against his cheek. He depresses ribbed platform 31. As shown in FIG. 3, through the hinging mechanism of tube 43, platform 31 moves downwards. Seat 39, bearing against valve 7, depresses valve 7 to cause shaving cream to be dispensed from the can through valve 7, tubes 35 and 43, nozzle 53 and duct 61, onto bristles 11 (and the face of the purchaser).

Description of the Preferred Embodiment

Another embodiment of applicant's invention is shown in FIGS. 5–10. In this embodiment, the bristles of the brush are parallel to the axis of the cylindrical aerosol can. For ease of reference, elements of the embodiment shown in FIGS. 5–10 which have direct counterparts in the embodiments of FIGS. 1–4 are generally given the same reference numeral.

Figure 6:
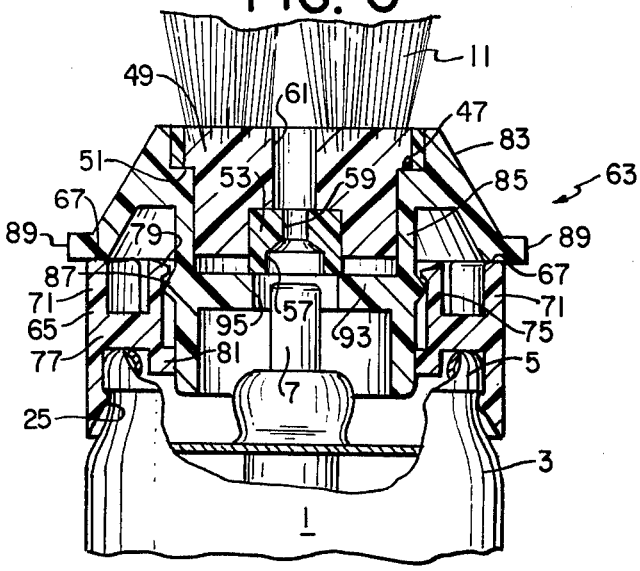
FIG. 6 is a partial cross-sectional side elevation view of the second embodiment of the present invention.
Figure 7:
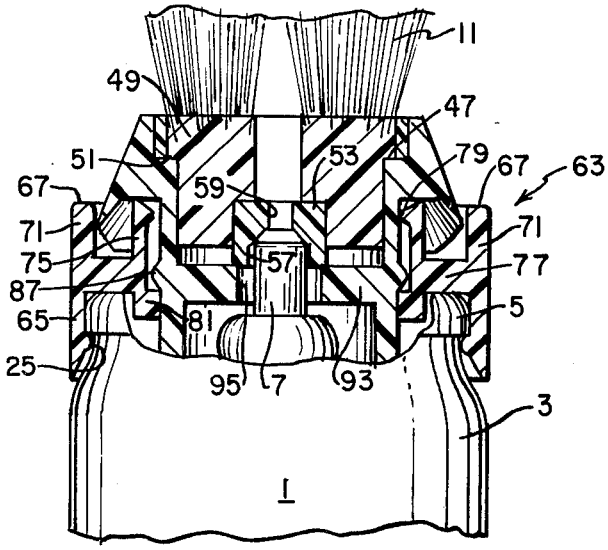
FIG. 7 is a view of the second embodiment of the present invention during its operated state and is similar to the view shown in FIG. 6.
Figure 8:
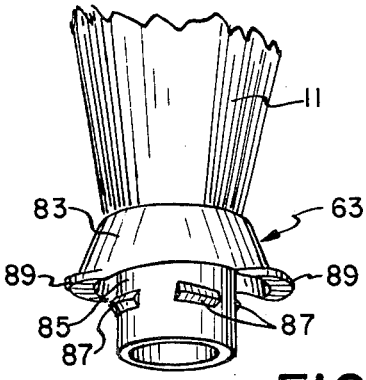
FIG. 8 is a perspective view of the cap and bristle portion of the second embodiment of the present invention.
Figure 9:
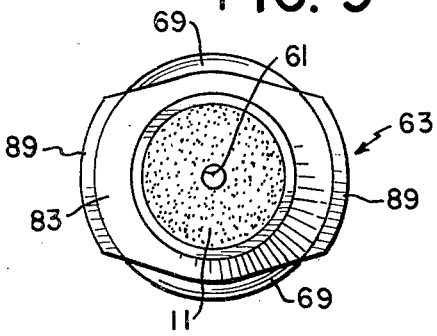
FIG. 9 is a view similar to that of FIG. 10 with the flanges in an unoperated position.
Figure 10:
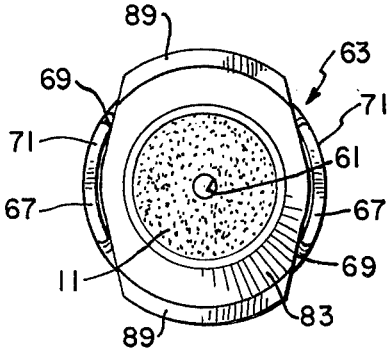
FIG. 10 is a plan cross-sectional view along lines 10—10 of FIG. 5 of the second embodiment of the present invention with the flanges in an operable position.

As shown in FIGS. 6 and 7, can 1 has a flange 5 and valve 7. Similarly, housing 63 has a lip 25 on outer annular wall 65 which engages flange 5 in the same manner as lip 25 engages flange 5 in the embodiment of FIGS. 1–4.

Outer wall 65 extends upwardly from can 1, concentric with valve 7. Outer wall 65 terminates in an upper surface 67 which has two diametrically opposed notches 69 separated by diametrically opposed shoulders 71.

Spaced from outer wall 65 is inner annular wall 75. Annular wall 75 is attached to outer wall 65 by ring 77. Annular wall 75 has inwardly extending annular flanges 79 and 81 at its top and bottom extremities respectively.

A cap 83 having an annular wall 85, concentric with wall 75, slides in the bore defined by wall 75. Wall 85 extends below bottom flange 81 and above top flange 79 of wall 75. Lips 87 on the outer surface wall 85 limit the axial movement of cap 83 to prevent cap 83 from coming apart from housing 63.

During its axial movement cap 83 is confined in a radial direction by the outer surface of annular wall 85 bearing against the inner surface of flange 81. That is, the inner surface of flange 81 is a bearing for the axial movement of cap 83.

Extending outwardly and downwardly from the top of wall 85 are two diametrically opposed flanges 89. The arc of flange 89 is smaller than the arc of notches 69.

The bore defined by an annular wall 85 is divided by ring 93. The central opening 95 of ring 93 is larger than the outer diameter of valve 7, permitting valve 7 to freely pass through ring 93. Abutting the upper surface of ring 93, concentric with opening 95, is nozzle 53. As with the previous embodiment, nozzle 53 has an enlarged bore 57 and orifice 59 which opens into duct 61 of base 49. As shown in FIG. 7 bore 57 has a diameter sufficient to permit nozzle 53 to slip over valve 7. Seat 58 is located where bore 57 narrows into orifice 59. As above, base 49 is removably mounted in cap 83.

As shown in FIG. 6 when flanges 89 rest on shoulders 71, nozzle 53 is not in contact with valve 7. Moreover, because flanges 89 rest on shoulders 71, it is not possible to depress cap 83.

However, when cap 83 is rotated to place flanges 89 over notches 69, cap 83 may advance into housing 63. Under its own weight cap 83 may advance until seat 58 contacts valve 7. Without further aid, the normal upward bias of nozzle 7 prevents further advancement of cap 83.

Operation of Embodiment of FIGS. 5–10

As with the first embodiment, the purchaser of standard shaving cream aerosol can 1 replaces the foam nozzle with applicant's invention by snapping annular lip 25 over flange 5. To operate the embodiment of FIGS. 5–10, the purchaser first checks to see that flanges 89 are above notches 69. The purchaser may then moisten bristles 11.

He then depresses cap 83 into housing 63. Bore 57 of nozzle 53 slides over valve 7. Seat 58 depresses valve 7, causing the shaving cream stored in can 1 to flow through valve 7, bore 58 and duct 61 onto bristles 11.

To prevent accidental depression of cap 83, either during storage of can 1 or utilization of bristles 11 to massage the shaving cream into the purchaser's face, cap 83 may be rotated to bring flanges 89 above shoulders 71. In this position, flanges 89 engage the top surface of shoulders 59, preventing cap 83's advancement into housing 63.

While this invention has been described by specific embodiments, it is not to be limited thereto, for obvious modifications will occur to those skilled in the art without departing from the scope of this invention.

What is claimed is:

1. A lather dispensing shaving brush for attachment to a cylindrical aerosol can having an outwardly extending flange surrounding its top surface and an axially movable cylindrical valve on its top surface, the depression of which dispenses shaving cream through the valve comprising:

a housing;

an inwardly extending lip on said housing of smaller diameter than said flange for removably engaging said flange;

a base having outer and inner surfaces, said outer surface having bristles embedded therein and said inner surface having a cavity formed therein for receiving a nozzle member, said base being removably mounted in said housing;

a duct formed in said base having one end opening into said outer surface and its other end opening into said cavity;

a foam producing nozzle member disposed in said base cavity having an orifice concentric and communicating with said other end of said duct;

an enlarged bore connected to said orifice for slipping over the valve;

a seat terminating said enlarged bore for engaging the top surface of the valve; and means for selectively moving said seat to depress the valve, whereby the shaving cream is dispensed from the can, through the valve, and into said bristles.

2. A lather dispensing shaving brush as in claim 1 including:

a tube connecting said enlarged bore to said nozzle member having a first end and a second end, said first end firmly attached to said housing, and said second end terminating in said enlarged bore;

and said selectively moving means including a platform substantially perpendicular to the axis of said valve mounted on said tube over said valve for selectively depressing said tube, whereby depressing said platform causes said seat to move said valve inward into the can to dispense said shaving cream from the can, through the valve, and into said bristles.

3. A lather dispensing shaving brush as in claim 2 wherein said bristles are at substantially right angles to the axis of said valve.

4. A lather dispensing shaving brush as in claim 2 wherein said platform has ribs on its top surface.

5. A lather dispensing shaving brush as in claim 1 wherein:

said housing includes an outer housing and a cap, said outer housing having said inwardly extending lip, said cap having said base removable mounted therein with said enlarged bore mounted above and coaxial with said valve and said cap slidably mounted in said outer housing, whereby depression of said cap causes said enlarged bore to slip over said valve and said seat to depress said valve, whereby the shaving cream is dispensed from the can, through the valve, and into said bristles.

6. A lather dispensing shaving brush as in claim 5 wherein:

said cap includes two diametrically opposed outwardly and downwardly extending flanges;

and said outer housing includes two diametrically opposed upwardly extending shoulders for engaging said flanges and preventing downward axial movement of said cap when said flanges are above said shoulders.

* * * * *